US006755329B2

(12) United States Patent
Thompson

(10) Patent No.: US 6,755,329 B2
(45) Date of Patent: Jun. 29, 2004

(54) INSTANT WEARABLE CAP BILL SHAPER

(76) Inventor: Roger G. Thompson, 11965 Danforth St., Sterling Heights, MI (US) 48312

( * ) Notice: Subject to any disclaimer, the term of this patent is extended or adjusted under 35 U.S.C. 154(b) by 0 days.

(21) Appl. No.: 10/152,905

(22) Filed: May 22, 2002

(65) Prior Publication Data

US 2003/0217405 A1 Nov. 27, 2003

(51) Int. Cl.[7] ..... A42C 1/04
(52) U.S. Cl. ..... 223/14; 2/209.13
(58) Field of Search ..... 2/209.13, 244, 2/195.1; 223/84, 12, 14, 66; 40/329; D2/891, 892; 211/30–33

(56) References Cited

U.S. PATENT DOCUMENTS 5,778,448 A * 7/1998 Maher ..... 2/10
5,862,522 A * 1/1999 Cho ..... 2/195.1
5,908,146 A * 6/1999 Levin ..... 223/84
5,991,927 A * 11/1999 Barbaccia ..... 2/209.13
6,315,175 B1 * 11/2001 Berger ..... 223/84
6,510,972 B1 * 1/2003 Briskey ..... 223/24

* cited by examiner

*Primary Examiner*—Katherine Moran
(74) *Attorney, Agent, or Firm*—Donald W. Meeker

(57) ABSTRACT

A curved cap bill shaper has binding tabs at each end compression fitting the side edges of a cap bill and imparting a desired curvature to the cap bill. Mating curved arms hinged to the bill shaper may adjustably interlock below the cap bill sandwiching it therebetween. Protruding points from the bill shaper and the arms may pierce or indent the cap bill. Indicia may be placed on a top surface of the bill shaper which covers or partly covers the cap bill.

14 Claims, 2 Drawing Sheets

INSTANT WEARABLE CAP BILL SHAPER

BACKGROUND OF THE INVENTION

1. Field of the Invention

The present invention relates to hat shaping devices and in particular to a shaper for a visor or bill of a baseball cap or other hat with a forward extending visor or bill which instantly shapes the bill into the desired arch or curve and may be worn on the hat when the hat is on the head of the wearer and which may bear information and images related to sports teams, advertising, or any other desired information and images.

2. Description of the Prior Art

When baseball caps are sold the bill or visor of the cap is relatively flat. This is viewed as unacceptable in terms of a fashion statement or general desirability for wearing. Arching or curving the bill so that the two side edges of the bill are much lower than the center of the bill on a baseball cap also serves to create a lower sun shade on both sides of the eyes of the wearer to assist with the sun shade value of the elongated bill itself.

While there have been many hat shaping devices and a number of devices for shaping the bill or visor of a baseball cap, none provide an instant means of shaping a bill of a cap upon purchasing the cap, such as at a sporting event, and the capability of wearing the shaping device as an integral part of the cap.

U.S. Pat. No. 5,634,575, issued Jun. 3, 1997 to Scharrenberg, concerns an apparatus and method for reforming a visor of a baseball type cap including a flexible member to be positioned adjacent the visor and having retention plates along the sides or center thereof that form visor receiving slots to position and retain the visor during reforming. Clips may be used in lieu of slots to retain the visor. Straps or similar elongated devices are affixed to the sides of the flexible member and are tensioned to draw said sides together thereby imparting an increased angular contour to the visor, wherein the straps stretch straight across the bill between the bent down sides, so that if the cap were worn with the device attached, the view of the wearer would be blocked by the straps. Latches on the straps hold the desired tension and visor contour until the visor has assumed the new contour set. The method may include moisturizing the visor and may be performed iteratively to permit various intermediate contours to be sampled or as required to provide the desired semi-permanent visor set.

U.S. Pat. No. 5,991,927, issued Nov. 30, 1999 to Barbaccia, provides a shaping device wherein the bill of the cap fits into the shaping device such that the bill is shaped into the shape of the bill-shaping wall. The bill-support wall preferably further includes indicia of team enthusiasm and loyalty and a transparent plastic card-holder for storing and displaying a baseball card. The device is not wearable on the head of a wearer and would immediately slip off in active use.

U.S. Pat. No. 6,315,175, issued Nov. 13, 2001 to Berger, puts forth a device for reforming the brim of a cap having a flexible frame constructed of two flexible members and a third, hinged arcuate member, of rigid construction is provided. The two flexible members are attached to the top of the curved, rigid, bottom member and are maintained in a parallel relationship regardless of the degree of articulation of the bottom member around the hinge. This construction allows the user to insert a cap brim into the parallel slot and bend the device thereby imparting a variable degree of curvature to the brim of the cap. A ratchet device is connected to the bottom member to allow the device to be adjusted or set in a specific position to impart the desired curvature to the brim. In addition, the device has a mounting hook at one end for hanging so that it can be used as a storage or display device while the cap is retained therein. The cap is not wearable with the device in place.

U.S. Pat. No. 5,908,146, issued Jun. 1, 1999 to Levin, discloses a device for bowing the brim of a cap and for storing, transporting, washing and/or displaying such cap having a body portion with first and second retention arms extending upwards at each end thereof forming first and second receipt areas at their junctions for receipt therein of the first side and second side of the cap brim, to form such brim into a desired curve. Notches can be disposed inward of each of the receipt areas for receipt of one side of the brim to form alternate brim receipt areas for different desired brim curvatures. The cap is not wearable with the device attached.

U.S. Pat. No. 5,012,531, issued May 7, 1991 to Schoonover, claims a form retaining holder or case for a visored cap comprising an upper shell and a lower shell, both shell portions sized and adapted to accommodate a visored type cap, such as used in the game of baseball, when the back portion of the cap is folded forwardly into the interior of the front portion of the cap. In such a holder, the cap is interposed between the upper shell and lower shell so that the form of the cap is retained during carriage and storage, and some modicum of protection for the cap is provided. The upper shell and lower shell are connected by means of known fastening means and by a lip disposed on the lower surface of the visor portion of the upper shell, such lip adapted to engage the visor of lower shell therein. Ventilation holes may be provided both upper and lower shell portions, particularly in portions adjacent to the periphery of the crown portion of the cap where it closely accommodates the wearer's head. The device covers the entire front of the cap and would therefore cover the insignia on the cap and be undesirable for wearing. The presence of the device would alter the cap size and therefore also be undesirable for wearing.

What is needed is an inexpensive construction of a simple band which can be fit adjustably around the cap bill and conform attractively to the bill so that it could be instantly applied to a cap upon purchasing the cap and worn with the cap and instantly shape the bill of the cap to a desired curvature and provide a means to display advertising or a unique message of personal expression or an advertising or sports related message and/or image.

SUMMARY OF THE INVENTION

An object of the present invention is to provide a cap bill shaping device which conforms attractively to the surface of the bill and shapes the bill into a desired curvature so that the device may instantly be applied to the cap upon purchase of the cap shaping the bill of the cap.

Another object of the present invention is to provide an instantly applied cap bill shaping device which may contain an advertising, sports related, personal message or other indicia which may be associated with the event at the place of purchase, such as a sporting event at a sports stadium, so that the cap purchased may have the bill shaper of the present invention applied at the place of purchase to instantly shape the cap bill and worn to display the indicia on the bill related to the event.

One more object of the present invention is to provide a cap bill shaping device which is securely attached to the cap bill and will not slip off even if worn in a sports event.

An additional object of the present invention is to provide a cap bill shaping device that may be constantly on the bill during use in wearing the cap and during storage when the cap is not being worn so that the cap bill always retains its shape and never loses the desired arch or curvature.

A further object of the present invention is to provide a cap bill shaping device which is inexpensive to manufacture while still adhering effectively to the cap bill for use in wearing the cap by providing protruding points built into the bill shaping device with pierce or indent the surface of the cap bill on the underside to permanently engage the cap bill if desired.

A contributory object of the present invention is to provide a cap bill shaping device which is fabricated of an imprintable material, including molded plastic, which may be imprinted at any time for any given event.

In brief, an arched or curved rigid strip of molded plastic or other material, such as a formed rigid curved strip of leather or paperboard material, is provided with a cap bill binding element at each end having a rigid tab spaced away from the cap bill shaper a distance slightly less than the thickness of a cap bill, so that the side edges are insertable between the tabs and the cap bill shaper with a tight compression fit with the tab embedded in the underside of the cap bill and the cap bill is retained therein with the top surface of the cap bill conforming to the curvature of the underside of the cap bill shaper so that the cap bill retains the same curved shape.

The cap bill shaper may be a band of material having a width less than the full length of the cap bill or have a width equal to the length of the cap bill or greater than the cap bill and thereby cover the entire top surface of the cap bill.

The cap bill shaper my be further provided with small pointed protrusions from the cap bill shaper extending into the cap bill to indent or pierce the cap bill, preferably on the underside of the cap bill and thereby prevent the cap bill shaper from slipping off of the cap bill. If the cap bill shaper is wider than the length of the cap bill, the cap bill shaper provides a greater surface for imprinting or branding or impressing or otherwise applying indicia thereto and also provides additional sunshade beyond the front of the cap bill.

In addition, the cap bill shaper may have a cap bill binding element on a front side of the cap bill shaper capable of hooking over and engaging a front edge of the cap bill for further gripping action on the cap bill.

Curved rigid interlocking adjustable arms may also be provided conforming to the same shape as the cap bill shaper and hinged to the cap bill shaper so that they may be overlapped under the cap bill and pressed against a bottom side of the cap bill to further assist in retaining the cap bill shaper in place on the cap bill and in maintaining the desired curvature of the cap bill. Protruding points from the cap bill shaper indenting or piercing the underside of the cap bill further assist in retaining the cap bill shaper on the cap bill.

An advantage of the present invention is that it provides a means for a user to acquire a cap and instantly apply the cap bill shaper to the cap to wear the cap and have the cap bill conform to the curvature of the cap bill shaper.

Another advantage of the present invention is that it provides a means for maintaining the desired curvature of the cap bill at all times by having the cap bill shaper attached to the cap bill at all times, including while wearing the cap, hanging up the cap, transporting the cap, or any other time.

An additional advantage of the present invention is that it allows the user to make a particular statement with the indicia on the cap bill shaper, whether it is a personal statement, showing team spirit, targeting a particular event, or any other desired indicia which may be placed on the cap bill shaper.

One more advantage of the present invention is that the cap bill shaper will not fall off of the cap bill even during intensive use of the cap, is in a sporting event, because the cap bill shaper grips the cap bill securely at the edges of the cap bill and also indents or pierces the surface of the cap bill to retain the cap bill shaper securely in place on the cap bill.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

Figure 1:
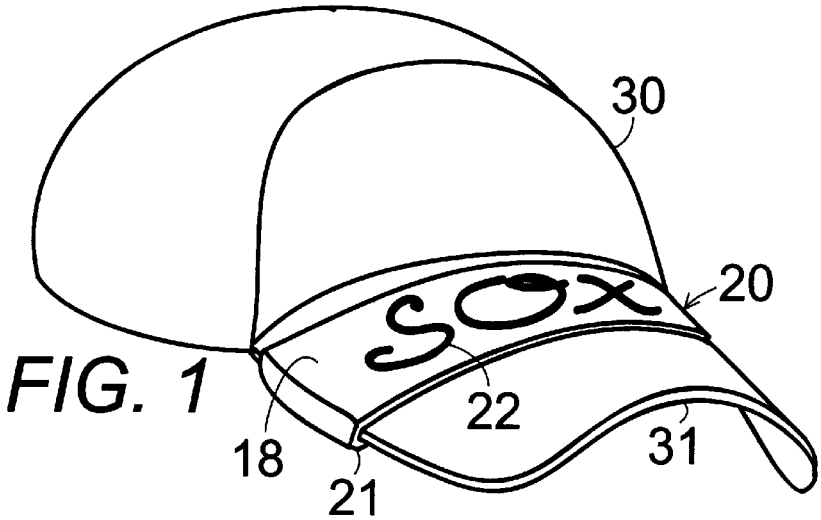
FIG. 1 is a perspective view showing the top of the cap bill shaper of the present invention with the indicia displayed as the cap bill shaper is installed on the cap bill, the cap bill shaper being formed in an elongated strip narrower in width than the length of the cap bill.

In FIGS. 1–7, a cap bill shaper device, which may be instantly applied to a cap visor or bill 31 of a baseball type cap 30 or other cap having a front visor or bill and worn with the cap bill shaper device in place on the cap bill, comprises a curved shaper strip 20, 20A and 20B slightly greater in length than a width of a cap bill 31. The shaper strip has an exposed upperside which may bear indicia 22 imprinted, embossed, burned or otherwise applied to the upperside 18 of the bill shaper device and exposed to view. The underside 19 is capable of contacting a top surface of a cap bill 31 and capable of making the cap bill 31 conform to the shape of the curved shaper strip 20, 20A and 20B. An attached spaced tab 21 at each end of the shaper strip is distanced from an the underside 19 of the shaper strip by an amount less than the thickness of the cap bill 31 so that the tab 21 is capable of securing the side edges of the cap bill against the underside of the curved shaper strip with a tight compression fit.

At least one pointed protrusion 25 extends from the cap bill shaper device and engages the cap bill 31 to assist in retaining the cap bill shaper 20, 20A and 20B in place on the cap bill 31.

The cap bill shaper device of claim 1 wherein the curved shaper strip is fabricated of a semirigid material, preferably molded plastic or nylon or rubberized plastic or other material, capable of bending outwardly to receive the cap bill 31 insertable between the tabs 21 and the shaper strip 20, 20A and 20B in a relatively flat configuration of the cap bill and further capable of bending back into the curved configuration for shaping the cap bill 31.

Figure 6:
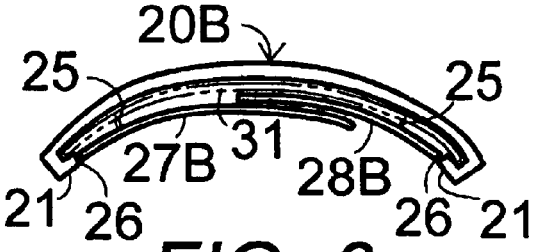
FIG. 6 is a front elevational view of the cap bill shaper of FIG. 1 or of FIG. 4 having a pair of adjustable interlocking hinged rigid arms interconnected on the underside of the cap bill to further assist in shaping the cap bill with the desired curvature and holding the cap bill shaper in place on the cap bill and showing sharp protrusions from the arms engaging the cap bill.
Figure 7:
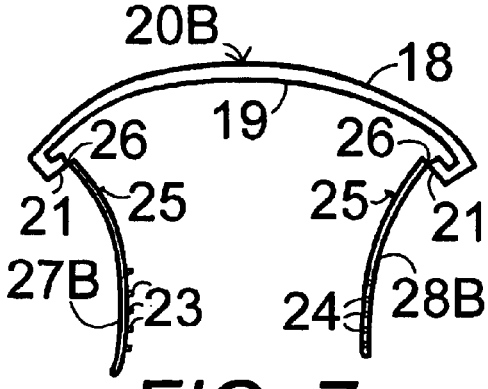
FIG. 7 is a front elevational view of the cap bill shaper of FIG. 6 with the hinged rigid arms open.

In FIGS. 6 and 7, the cap bill shaper 20C further comprises a pair of curved arms 27B and 28B pivotally attached as by living hinges 26 with one of the pair at each end of the shaper strip 20C. The pair of curved shaped arms 27B and 28B have adjustable interlocking means, such as protruding tabs 23 and mating receiving holes 24 and have a curvature mating with the curvature of the shaper strip 20B so that the pair of curved shaped arms are capable of pivoting up into contact with the underside of the cap bill 31 and sandwiching the cap bill therebetween for further assisting in shaping the cap bill and retaining the cap bill shaper 20B on the cap bill 31, as seen in FIG. 6.

Pointed protrusions 25 extend from the pair of curved arms 27B and 28B and engage the cap bill 31 by piercing or indenting the cap bill surface and assist in retaining the cap bill shaper 20C in place on the cap bill 31 so that the cap bill shaper may be worn on the cap and not fall off even in sporting events.

Figure 4:
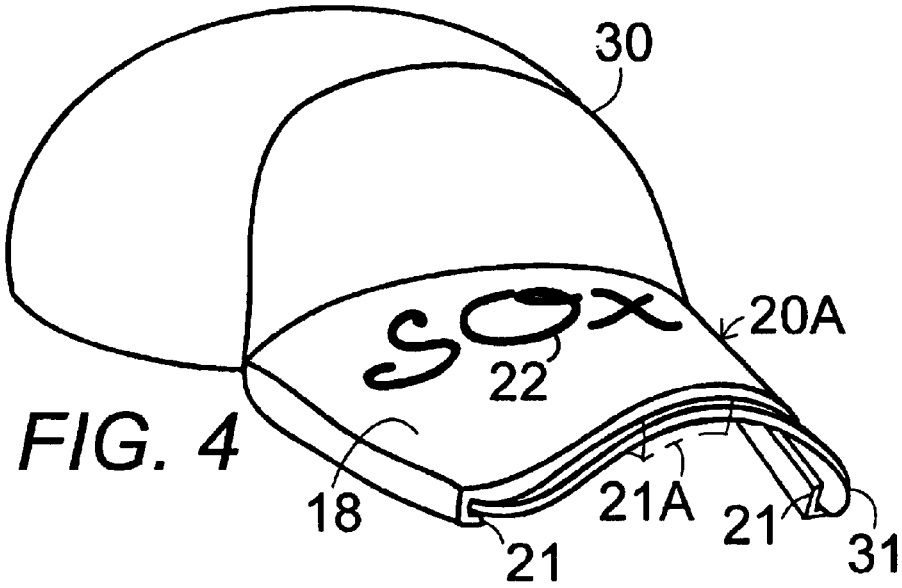
FIG. 4 is a perspective view showing the top of the cap bill shaper of the present invention with the indicia displayed as the cap bill shaper is installed on the cap bill, the cap bill shaper being formed in an elongated strip equal in width to the length of the cap bill and having an additional front edge gripper for gripping the cap bill.
Figure 5:
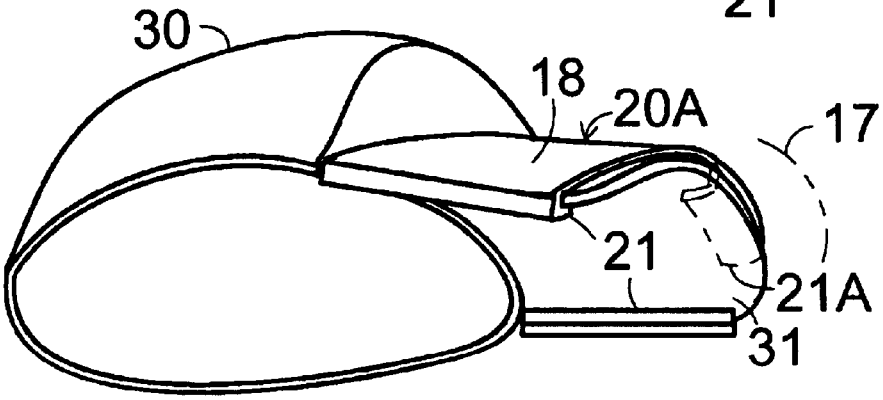
FIG. 5 is a perspective view showing the underside of the cap bill shaper of FIG. 4 installed on the cap bill.

In FIGS. 4 and 5, a full coverage embodiment of the cap bill shaper 20A covers the entire top surface of the cap bill 31 and may have an attached spaced tab 21A on a front side edge of the shaper strip distance from the underside of the shaper strip by an amount less than the thickness of the cap bill so that the tab 21A is capable of securing a front edge of the cap bill 31 against the underside of the curved shaper strip with a tight compression fit.

In FIGS. 1 and 4 the exposed upperside of the shaper strip 18 is capable of receiving indicia 22 applied thereto, such as sports related information or personal information or advertisements or any type of imprinted or otherwise applied words and images, including decals.

Figure 2:
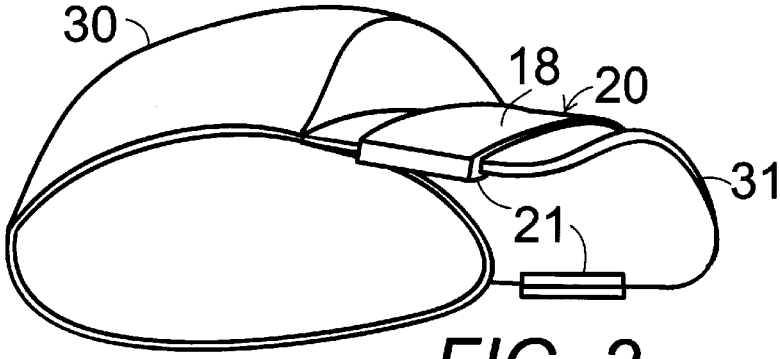
FIG. 2 is a perspective view showing the underside of the cap bill shaper of FIG. 1 installed on the cap bill.
Figure 3:
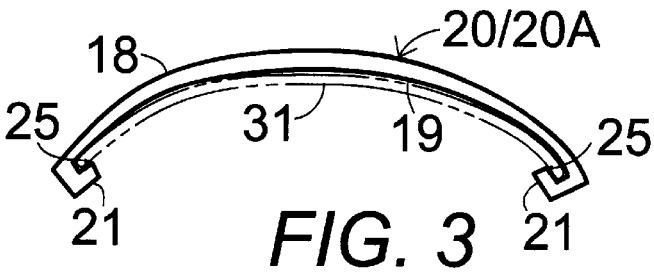
FIG. 3 is a front elevational view of the cap bill shaper of FIG. 1 or of FIG. 4.

In FIGS. 1 and 2 the cap bill shaper device 20 has a width less than the length of the cap bill 31. In FIGS. 4 and 5, the cap bill shaper 20A a width equal to the length of the cap bill 31. The dashed line 17 of FIG. 5 shows that the shaper strip 20A can have a width greater than the length of the cap bill.

It is understood that the preceding description is given merely by way of illustration and not in limitation of the invention and that various modifications may be made thereto without departing from the spirit of the invention as claimed.

What is claimed is:

1. A cap bill shaper device for a cap with a shapeable bill extending forward and side-to-side a sufficient distance to shade a forehead and eyes of a wearer, which device may be instantly applied to a shapeable cap bill and worn with the cap bill shaper device in place on the cap bill, the cap bill shaper device comprising:

a curved shaper strip slightly greater in length than a width of a shapeable cap bill, the shaper strip having an exposed upperside and an underside adapted to contact a top surface of a shapeable cap bill and adapted to make a shapeable cap bill conform to the shape of the curved shaper strip, the shaper strip having an attached spaced binding tab at each end distanced from an the underside of the shaper strip by an amount less than the thickness of a shapeable cap bill so that the binding tab is adapted to receive and compress and securely grip a portion of a side edge of a shapeable cap bill against the underside of the curved shaper strip with a tight compression fit so that the can bill shaper device will not fall off of a shapeable cap bill even during intensive use of the cap, as in a sporting event;

wherein the bill shaper device is fabricated in one piece of a semirigid material adapted to bend outwardly in a relatively flat configuration of the shaper strip and the binding tab is adapted to bend outwardly to receive a shapeable cap bill insertable between the binding tab and the shaper strip in a relatively flat configuration of the cap bill and further capable of bending back into the curved configuration for shaping a shapeable cap bill and binding a portion of the edges of a shapeable cap bill between the binding tab and the curved shaper strip.

2. The cap bill shaper device of claim 1 further comprising at least one pointed protrusion extending from the cap bill shaper device, the at least one pointed protrusion capable of engaging the cap bill and assisting in retaining the cap bill shaper in place on the cap bill.

3. The cap bill shaper device of claim 1 wherein the curved shaper strip is fabricated of a semirigid material capable of bending outwardly to receive the cap bill insertable between the tab and the shaper strip in a relatively flat configuration of the cap bill and further capable of bending back into the curved configuration for shaping the cap bill.

4. The cap bill shaper device of claim 1 further comprising a pair of curved arms pivotally attached with one of the pair at each end of the shaper strip, the pair of curved shaped arms having adjustable interlocking means and having a curvature mating with the curvature of the shaper strip so that the pair of curved shaped arms are capable of pivoting up into contact with the underside of the cap bill and sandwiching the cap bill therebetween for further assisting in shaping the cap bill and retaining the cap bill shaper on the cap bill.

5. The cap bit shaper device of claim 4 further comprising at least one pointed protrusion extending from the pair of curved arms, the at least one pointed protrusion capable of engaging the cap bill and assisting in retaining the cap bill shaper in place on the cap bill.

6. The cap bill shaper device of claim 1 further comprising an attached spaced binding tab on a front side edge of the shaper strip distanced from an the underside of the shaper strip by an amount less than the thickness of a shapeable cap bill so that the tab is adapted to receive and compress and securely grip a portion of a front edge of a shapeable cap bill against the underside of the curved shaper strip with a tight compression fit.

7. The cap bill shaper device of claim 1 wherein the exposed upperside of the shaper strip is capable of receiving indicia applied thereto.

8. The cap bill shaper device of claim 7 wherein the upperside of the shaper strip is capable of receiving imprinted indicia applied thereto.

9. The cap bill shaper device of claim 7 wherein the upperside of the shaper strip is capable of receiving at least one decal applied thereto.

10. The cap bill shaper device of claim 1 wherein the shaper strip has a width less than the length of a shapeable cap bill.

11. The cap bill shaper device of claim 1 wherein the shaper strip has a width equal to the length of a shapeable cap bill.

12. The cap bill shaper device of claim 1 wherein the shaper strip has a width greater than the length of a shapeable cap bill.

13. A cap bill shaper device which may be instantly applied to a cap bill and worn with the cap bill shaper device in place on the cap bill, the cap bill shaper device comprising:

a curved shaper strip slightly greater in length than a width of a cap bill, the shaper strip having an exposed upperside and an underside capable of contacting a top surface of a cap bill and capable of making the cap bill conform to the shape of the curved shaper strip, the shaper strip having an attached spaced tab at each end distanced from an the underside of the shaper strip by an amount less than the thickness of the cap bill so that the tab is capable of securing the side edges of the cap bill against the underside of the curved shaper strip with a tight compression fit;

a pair of curved arms pivotally attached with one of the pair at each end of the shaper strip, the pair of curved shaped arms having adjustable interlocking means and having a curvature mating with the curvature of the shaper strip so that the pair of curved shaped arms are capable of pivoting up into contact with the underside of the cap bill and sandwiching the cap bill therebetween for further assisting in shaping the cap bill and retaining the cap bill shaper on the cap bill.

14. The cap bill shaper device of claim 13 further comprising at least one pointed protrusion extending from the pair of curved arms, the at least one pointed protrusion capable of engaging the cap bill and assisting in retaining the cap bill shaper in place on the cap bill.

* * * * *